US008133049B1

(12) United States Patent
Sullivan et al.

(10) Patent No.: US 8,133,049 B1
(45) Date of Patent: Mar. 13, 2012

(54) MODULAR REFRACTORY SUPPORT SYSTEM

(76) Inventors: James Colman Sullivan, Topanga, CA (US); Diana Lea Mausser, Torrance, CA (US)

( * ) Notice: Subject to any disclaimer, the term of this patent is extended or adjusted under 35 U.S.C. 154(b) by 756 days.

(21) Appl. No.: 12/075,043

(22) Filed: Mar. 7, 2008

(51) Int. Cl.
*F27D 5/00* (2006.01)

(52) U.S. Cl. ..... 432/258; 432/261; 211/188

(58) Field of Classification Search ..... 432/258, 432/253, 261, 162; 211/188, 134, 135, 181, 211/187; 52/100; 248/223.41
See application file for complete search history.

(56) References Cited

U.S. PATENT DOCUMENTS 1,492,188 A * 4/1924 Young ..... 165/80.5
2,118,641 A * 5/1938 Diamond ..... 432/241
2,246,448 A * 6/1941 Mahan, Jr. ..... 432/259
3,632,095 A * 1/1972 Rode et al. ..... 432/253
3,870,155 A * 3/1975 Galloway ..... 211/74
4,195,732 A * 4/1980 Bell ..... 206/391
4,461,244 A * 7/1984 Riegger et al. ..... 122/441
4,506,796 A * 3/1985 Thompson ..... 211/59.4
4,610,362 A * 9/1986 Remp et al. ..... 211/59.4
4,653,651 A * 3/1987 Flum ..... 211/59.4
4,721,460 A * 1/1988 Bushman et al. ..... 432/241
5,123,547 A * 6/1992 Koch ..... 211/59.4
5,785,519 A * 7/1998 Becker et al. ..... 432/258
5,848,890 A * 12/1998 McCormick ..... 432/261
6,261,037 B1 * 7/2001 Richards et al. ..... 410/36
6,474,613 B2 * 11/2002 O'Malley ..... 248/346.02
6,644,966 B1 * 11/2003 Chiang ..... 432/253
7,185,770 B1 * 3/2007 Roten ..... 211/70.6
7,413,436 B2 * 8/2008 Wuenning ..... 432/246
7,922,012 B2 * 4/2011 Sisley ..... 211/60.1

* cited by examiner

*Primary Examiner* — Gregory A Wilson
(74) *Attorney, Agent, or Firm* — Colin P. Abrahams

(57) ABSTRACT

A variable modular support system for use in a kiln, as well as a method of constructing such a support system in a kiln, comprises plurality of refractory blocks each having an upper surface and a lower surface and at least one transverse recess in either the upper or lower surface, the plurality of refractory blocks comprising a first base refractory block and a second base refractory block spaced from the first refractory block by a variable and selectable distance. Connecting rods extend from the recess of the first base refractory block or a refractory block stacked thereon to the recess of the second base refractory block or a refractory block stacked thereon, the connecting rods forming a rack or shelf located between the first base refractory block and the second base refractory block.

17 Claims, 6 Drawing Sheets

MODULAR REFRACTORY SUPPORT SYSTEM

FIELD AND BACKGROUND OF THE INVENTION

This invention relates to modular refractory blocks or tiles. The invention is for a modular refractory block individually, and when used with other modular refractory blocks, to create a frame or support structure for holding ceramic tiles in a kiln during the firing process of the tile.

U.S. Pat. No. 6,644,966 (Chiang) discloses a carriage for supporting objects to be heated in a kiln comprising a pair of beams 2 with orifices 21. Rods are engaged between orifices of a pair of beams. Objects 8 or 9 to be heated are placed on the rods 4. A stack comprising the beams and rods may be formed. U.S. Pat. No. 1,885,691 (Dressler) teaches means for supporting ceramic ware while being fired in kilns. U.S. Pat. No. 2,923,997 (Emmerling) teaches a device for exposing ceramic ware to the heat of a kiln in the heat treatment of the ware, and particularly relates to a device for supporting ceramic tile during a glazing operation.

U.S. Patent Application No. 2004/0040245 (Sinclair) teaches a building block system and is more for use in constructing buildings than for use in a kiln. U.S. Pat. No. 2,745,276 (Kuhlman) discloses precast building units, not particularly for use in a kiln, the building blocks having channels disposed therein to accommodate pipes, cables etc. U.S. Pat. No. 2,462,289 (Rochow) teaches a furnace refractory construction including refractory bricks having at least one face provided with recessed portions.

U.S. Pat. No. 4,716,847 (Moreau) teaches a furnace wall comprising feed nozzles molded in two complementary paths, which may include a bundle of cylindrical and parallel pipes 24 which pass between elements in the openings. U.S. Pat. No. 3,471,136 (Hodl) teaches a rotary cement kiln lining block which includes channels 2.

SUMMARY OF THE INVENTION

According to one aspect of the invention, there is provided a variable modular support system for use in a kiln comprising: a plurality of refractory blocks each having an upper surface and a lower surface and at least one transverse recess in either the upper or lower surface, the plurality of refractory blocks comprising a first base refractory block and a second base refractory block spaced from the first refractory block by a variable and selectable distance; and connecting rods extending from the recess of the first base refractory block or a refractory block stacked thereon to the recess of the second base refractory block or a refractory block stacked thereon, the connecting rods forming a rack or shelf located between the first base refractory block and the second base refractory block.

Preferably, both the upper and lower surfaces have at least three equispaced recesses thereon, the recesses of the upper surface being in substantial alignment with the recesses on the lower surface.

The recesses may be of generally of semicircular shape, or have a generally semicircular base portion and substantially vertical side walls.

In one embodiment, the variable modular support system comprises a plurality of refractory blocks vertically stacked on the first base refractory block and a plurality of refractory blocks vertically stacked on the second base refractory block, preferably substantially parallel to one another, and wherein connecting rods forming a plurality of vertically arranged shelves extend in a generally horizontal plane between and perpendicular to the refractory blocks vertically stacked on the first base refractory block and the refractory blocks vertically stacked on the second base refractory block, the connecting rods being supported in the recesses of the refractory blocks.

Preferably, the refractory blocks and connecting rods are variably configured so as to optimize the use of space in the kiln and structured to support objects being fired or cured in a kiln based on the dimensions of the objects. The invention may include secondary support pieces which can be utilized to provide additional support to a vertical stack of refractory blocks.

According to another aspect of the invention, there is provided a method of stacking objects to be fired in a kiln by placing the objects on a variable modular support system formed in the kiln, the method comprising: arranging on the floor or base of the kiln a plurality of refractory blocks each having an upper surface and a lower surface and at least one transverse recess in either the upper or lower surface, the plurality of refractory blocks including a first base refractory block and a second base refractory block spaced from the first refractory block by a variable and selectable distance; and placing connecting rods which extend from the recess of the first base refractory block or a refractory block stacked thereon to the recess of the second base refractory block or a refractory block stacked thereon, so that the connecting rods form a rack or shelf located between the first base refractory block and the second base refractory block.

In one form, the plurality of refractory blocks are vertically stacked on the first base refractory block and a plurality of refractory blocks are vertically stacked on the second base refractory block, and wherein connecting rods are placed to form a plurality of vertically arranged shelves which extend in a generally horizontal plane between the refractory blocks vertically stacked on the first base refractory block and the refractory blocks vertically stacked on the second base refractory block, the connecting rods being placed for support in the recesses of the refractory blocks.

The refractory blocks and connecting rods may be variably configured so as to optimize the use of space in the kiln and structured to support objects being fired or cured in a kiln based on the dimensions of the objects. Further, secondary support pieces may be used to provide additional support to a vertical stack of refractory blocks.

Preferably, the refractory blocks are comprised of a material which is selected for its ability to withstand multiple firings in the kiln at high temperatures.

In one aspect, there is provided a modular refractory block in accordance with the invention which can be used with other refractory blocks to create a customized frame or support structure for supporting ceramic tiles during the firing process in a kiln.

In the field of ceramics, and related areas, it is common practice to mold or configure objects such as tiles or containers, using various types of materials, such as clay, and thereafter place the molded object in a kiln to be fired. In the kiln, there is a process whereby a clay tile is heated to the appropriate temperature over a period of time until the internal chemistry of the clay achieves a vitreous or semi-vitreous state rendering it resistant to water and chemicals. An secondary step before placing it in the kiln is the painting or glazing or other treatment of the object. The kiln is generally a large oven, having walls and a sealable opening or door, and structures of different shapes, sizes and configurations are placed therein. Therefore, in order to maximize used of the space within the kiln, the frame or support mechanism comprising the invention may be inserted into the kiln so that a plurality of differently shaped and sized objects can be placed in the kiln to optimally utilize the space available therein.

In one aspect, the modular refractory block of the present invention is directed towards a series of specially configured blocks which may be assembled or located with a number of other similarly configured blocks in order to create a frame, rack or other form of support, in order to create spaces and distances within the kiln, for optimal placement of objects to be set within the kiln. Preferably, and in accordance with one aspect of the invention, the modular refractory block is used in association with rods made of a similar refractory material, and the modular refractory blocks, in combination with the rods, may be configured in any desired manner, so as to create a rack or framework suitable for a particular job.

Preferably, each modular refractory block, in accordance with the invention, has an upper surface and a lower surface, the upper surface having one or more transverse grooves spaced therealong. Furthermore, the bottom surface of the modular refractory tile may also have a series of transverse spaced grooves running therealong, and these grooves in the upper and lower surfaces may, in accordance with the invention, be substantially opposed to each other and thereby register with each other. The grooves are preferably but not necessarily semi-circular in shape, and are designed to receive at least the end of cylindrical-shaped (or other shaped) rods, so that a cylindrical-shaped rod can extend from the groove of one refractory block to the groove of another one, arranged in a spaced relationship therewith. Support shelves or racks are thereby created and dimensioned according to specific need based on the objects they will support.

The modular refractory block of the invention is thus designed to support ceramic tiles during the firing process of the tiles. The modular refractory block may be made from a high-fired refractory material, meaning that it is typically fired at between 2,300 and 2,500 degrees F. The refractory material may be ram, or dry-pressed, either of which process will create an equally durable product.

The material and the technique for pressing the modular refractory block is of some importance in creating a block that is not only durable, but also strong enough to withstand literally thousands of heating and cooling firings in the kiln. As will be appreciated, kilns are fired up and cooled down on an ongoing basis in order to cure many products, and the refractory block of the invention is preferably constructed so as to be able to withstand these extremes in multiple firings and uses.

The temperature of a firing in a kiln is sometimes measured by "cone" levels. For tile firings up to cone 1, which is approximately 2,100 to 2,150° F., the refractory block of the invention will be extremely durable through thousands of firings. The refractory block of the invention is indeed capable of being fired in kilns fired up to cone 8, which is approximately 2,300 to 2,375° F., with a potentiality for only a slightly diminished life.

In typical practice, in one aspect of the invention, two refractory blocks are necessary for the proper function of the system. These refractory blocks may be placed in the kiln (or oven) generally parallel to one another, and spaced with enough distance between them to allow for one or more tiles or other objects to be supported thereby when placed in the kiln, depending upon the size of the tile and the size of the kiln.

In one refractory block of the invention, three grooves are designed therein to accommodate three rods. The rods may be approximately a half inch in diameter, although the size, shape and dimensions of the rod will of course vary, depending upon the nature of the task at hand. The rods are also made of a refractory material and are generally available commercially. The rods are placed to rest in the grooves, between the two parallel refractory blocks, thereby creating a bridge and forming a support surface or rack between the modular refractory blocks of the invention. The tiles to be placed in the kiln are then located on top of the rods to be supported thereby, and it may then be possible to place one further refractory block on top of each one of those already placed and spaced apart from each other. Adding blocks in a stacked configuration may have at least two benefits. One benefit is that the rods resting in the groove of the lower refractory block are then sandwiched between the upper and lower refractory blocks, thus making them more stable and less likely to move or shift by casual knocking or heat effects. As such, they will not slide or be knocked out of position when in use.

In addition, the stacked upper refractory block on each side may also have grooves in its upper surface, and may form the location or cradle for further refractory rods to be placed, creating an additional shelf. Depending upon the size, configuration and requirements of the user, a series of substantially vertical shelves may be established between two spaced towers of stacked refractory blocks, thereby creating more usable space within the kiln. The structure of stacked refractory blocks and rods may be customized depending upon the nature of the tiles etc. being fired. Not only will this expedite processing of tiles, but it will also potentially save energy by using the space available in a kiln in an optimal manner.

It should be noted that this arrangement is just one of many configurations which can be constructed in accordance with the modular refractory blocks of the invention when used in combination with the refractory rods.

The refractory block in combination with the refractory rods in accordance with the invention is particularly suitable for use in top-loading kilns, but would work very well in front-loading kilns as well. Furthermore, the refractory blocks may be stacked to significant heights, and the extent of stacking will of course depend upon their size, particularly their base dimensions, in order to ensure stability of the structure. Indeed, up to fifteen or more refractory blocks may be stacked one above the other if they are free-floating inside the kiln without using at least one wall of the kiln as a form of support. If the refractory blocks are free-floating inside the kiln without being supported by the kiln walls, specially configured refractory tower pieces may be used to give additional stability to the structure, and therefore support the stacked refractory blocks and prevent any unintended toppling.

Whether the refractory blocks are stacked in an unsupported manner, i.e. one above the other without any additional structure added for stability, or whether they are supported by the kiln walls or other forms of stabilizing structure, it is always wise to ensure that each refractory block is centered exactly on top of the refractory block immediately below it, since this will provide the greatest area of contact and support between the refractory blocks as they are stacked higher, and therefore impart greater stability to the growing structure.

DETAILED DESCRIPTION OF THE INVENTION

Reference is now made to the drawings which show various embodiments of the modular refractory block of the invention, as well as the rack system, and it should be appreciated that these are exemplary illustrations and the blocks may take a wide range of different forms and structures in accordance with the principles of this invention.

Figure 1:
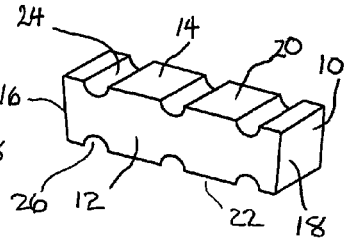
FIG. 1 is a perspective view of a refractory block in accordance with one aspect of the invention.
Figure 7:
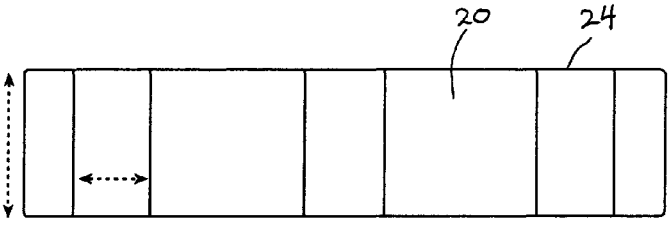
FIG. 7 is a top view of the refractory block shown in FIG. 5 of the drawings.
Figure 8:
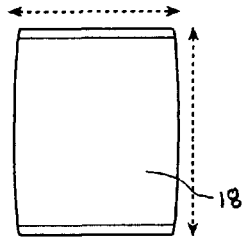
FIG. 8 is an end view of the refractory block shown in FIG. 5 of the drawings.
Figure 6:
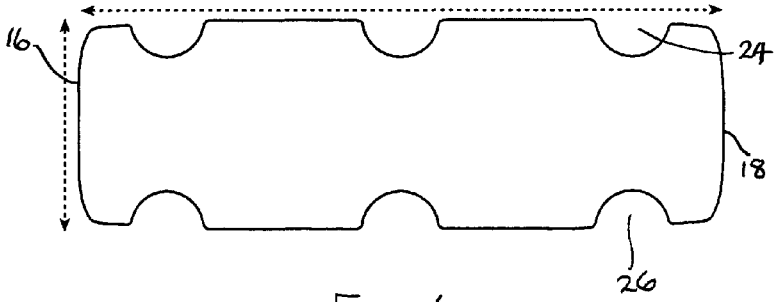
FIG. 6 is a side view of the refractory block shown in FIG. 5 of the drawings.

As will be seen in FIG. 1 of the drawings, there is shown a refractory block 10 of generally rectangular shape, having a front face 12, a top face 14, and side edges 16 and 18. The refractory block has an upper surface 20, as well as a lower surface 22. The upper surface has three equi-spaced, transversely oriented grooves 24, while the lower surface 22 has three corresponding transversely oriented grooves 26. The grooves 24 and 26 respectively are intended to receive and hold a portion of a refractory bar or rod, as will be described in further detail below.

Figure 3:
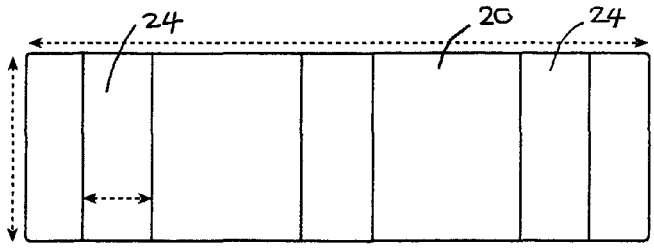
FIG. 3 is a top view of the refractory block shown in FIG. 1 of the drawings.
Figure 4:
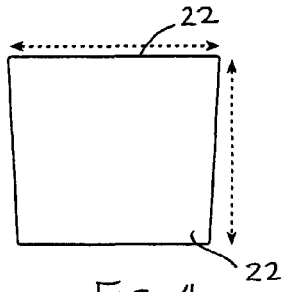
FIG. 4 is an end view of the refractory block shown in FIG. 1 of the drawings.
Figure 2:
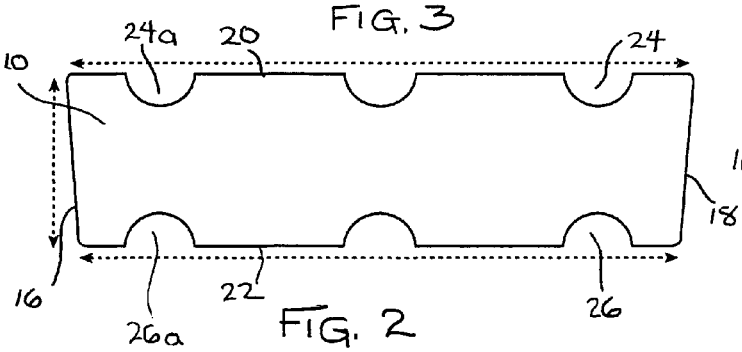
FIG. 2 is a side view of the refractory block shown in FIG. 1 of the drawings.

It will be seen from FIG. 2 of the drawings, which shows a side view of the refractory block 10 shown in FIG. 1 of the drawings, that the side edges 16 and 18 taper slightly between the upper surface 20 and lower surface 22 so that the upper surface 20 is slightly longer than the lower surface 22. It will also be clearly seen, from FIG. 2, that the grooves 24 and 26 are in substantial vertical alignment so that, for example, the groove 24*a* in the upper surface 20, is vertically aligned with the groove 26*b* in the lower surface 22 of the refractory block 10. While the grooves 24 and 26 may be of many different shapes and dimensions, those shown in FIGS. 1 to 5 of the drawings are generally semi-circular, a more convenient shape for receiving a cylindrical-shaped refractory rod or bar, as will be described.

In one preferred embodiment of the invention, the refractory block shown in FIGS. 1 to 4 of the drawings has a height of about 1.25 inches, the length of the upper surface 20 is approximately 4.5 inches, and the length of the lower surface 22 is about 4.25 inches. The width of the refractory block is approximately 1.375 inches and, preferably, each of the grooves has a diameter of about a 0.5 inch. It will be appreciated that these dimensions are purely examples of the wide range of size that can be used, and the dimensions provided may be suitable for supporting tiles of substantially regular shape and size within a kiln. However, for larger objects being placed in the kiln for firing, the size and dimensions of the refractory block 10, as well as the rods for use therewith, can be increased for additional strength as desired.

Figure 5:
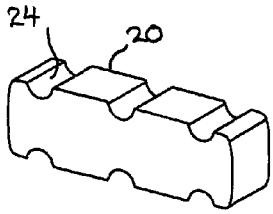
FIG. 5 is a perspective view of a refractory block in accordance with another embodiment of the invention.

With reference to FIGS. 5 to 8 of the drawings, there is shown a refractory block 40 of slightly different configuration. In these FIGS. 5 to 8, the same reference numerals have been used to designate like elements, as were used with reference to FIGS. 1 to 4 of the drawings. It will be seen that the refractory block shown in FIGS. 5 to 8 has a slightly different shape, and does not taper from the upper surface 20 to the lower surface 22, as shown in FIG. 1. In FIG. 5, the refractory block has somewhat rounded side edges 16 and 18, and the block 40 itself, as will be apparent from the end view in FIG. 8, bulges just slightly from between the upper and lower surfaces. Otherwise, the refractory block 40 is in many respects similar to that shown in FIGS. 1 to 4, with similar but not identical dimensions.

Figure 9:
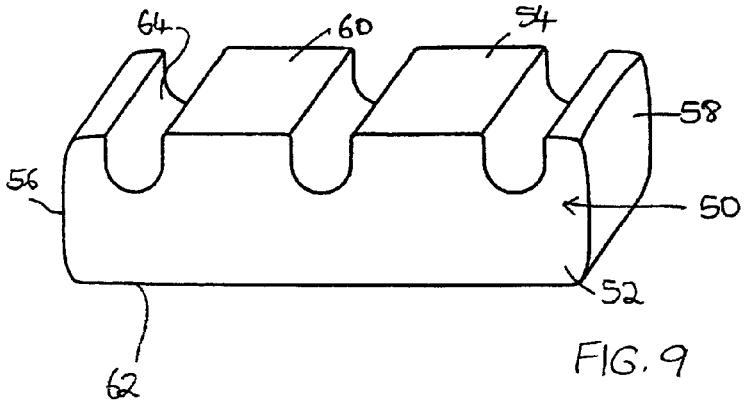
FIG. 9 is a perspective view of a refractory block in accordance with yet a further embodiment of the invention.

With reference to FIG. 9 of the drawings, there is shown a refractory block 50 in accordance with another aspect of the invention. The refractory block 50 has a front face 52, a rear face 54, side edges 56 and 58, as well as an upper surface 60, and a lower surface 62. The side edges 56 and 58 are somewhat rounded, and the refractory block 50 is substantially rectangular in shape.

On the upper surface 60, there are formed three grooves which are of slightly greater depth than the semi-circular grooves shown in the preceding drawings. In one form of the invention, each of the grooves 64 has sufficient depth so as to completely or substantially accommodate a refractory rod or bar, so that the refractory rod or bar will not significantly project above the upper surface 60 of the refractory block 50.

It will also be noted that the lower surface 62 is generally a flat surface, with no grooves therein. It will thus be seen that when one refractory block 50 is stacked on top of another, the refractory bars will be fully accommodated within the groove 64, so that the lower surface 62 of the top refractory block can rest with significant stability on the upper surface 60 of the refractory block 50 below it. In this embodiment, therefore, it is only necessary to have grooves on either the upper or lower surface, in this case the upper surface, since the refractory block 50 will be fully accommodated therein.

Figure 10:
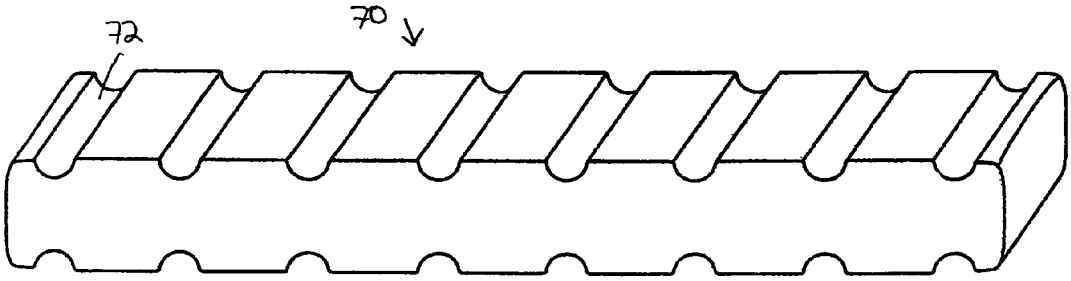
FIG. 10 is a perspective view of a refractory block in accordance with yet a further embodiment of the invention.

With reference to FIG. 10 of the drawings, there is shown a further embodiment of the invention. In this embodiment, a refractory block 70 has the basic style and configuration of the refractory blocks shown in the previous embodiments, but the refractory block 70 is longer and has more grooves 72. In the embodiment of FIG. 10, the refractory block has eight grooves 72 across the upper surface and eight corresponding grooves along the lower surface thereof, and is obviously capable of creating a larger support and rack and supporting more tiles or other objects which are being fired in the kiln.

Figure 11:
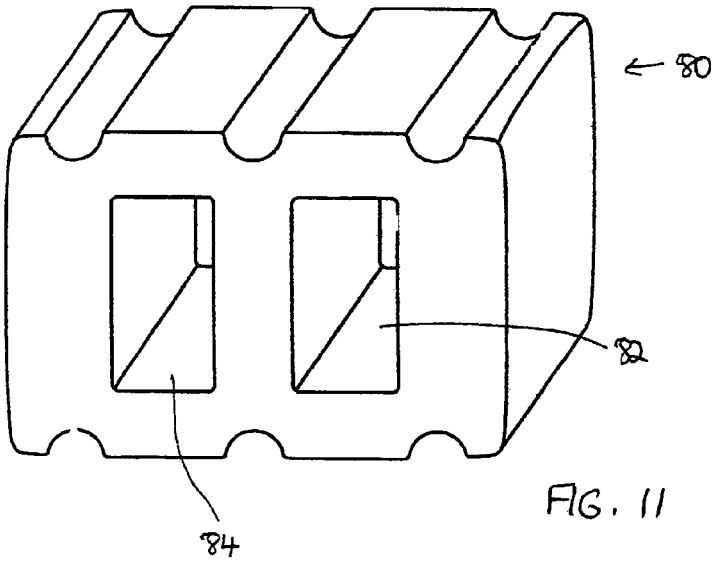
FIG. 11 is a perspective view of a refractory block in accordance with yet a further embodiment of the invention.

In FIG. 11 of the drawings, yet another embodiment of a refractory block 80 is shown. This refractory block 80 is somewhat similar to that shown in FIG. 6 of the drawings but the center portion is expanded or increased in dimension and two apertures 82 and 84 therein. A refractory block 80 as shown in FIG. 11 may be used in the situation where greater vertical clearance is required between racks of rods, typically where the tile or other object being fired in the kiln is higher than would normally be the case.

Figure 12:
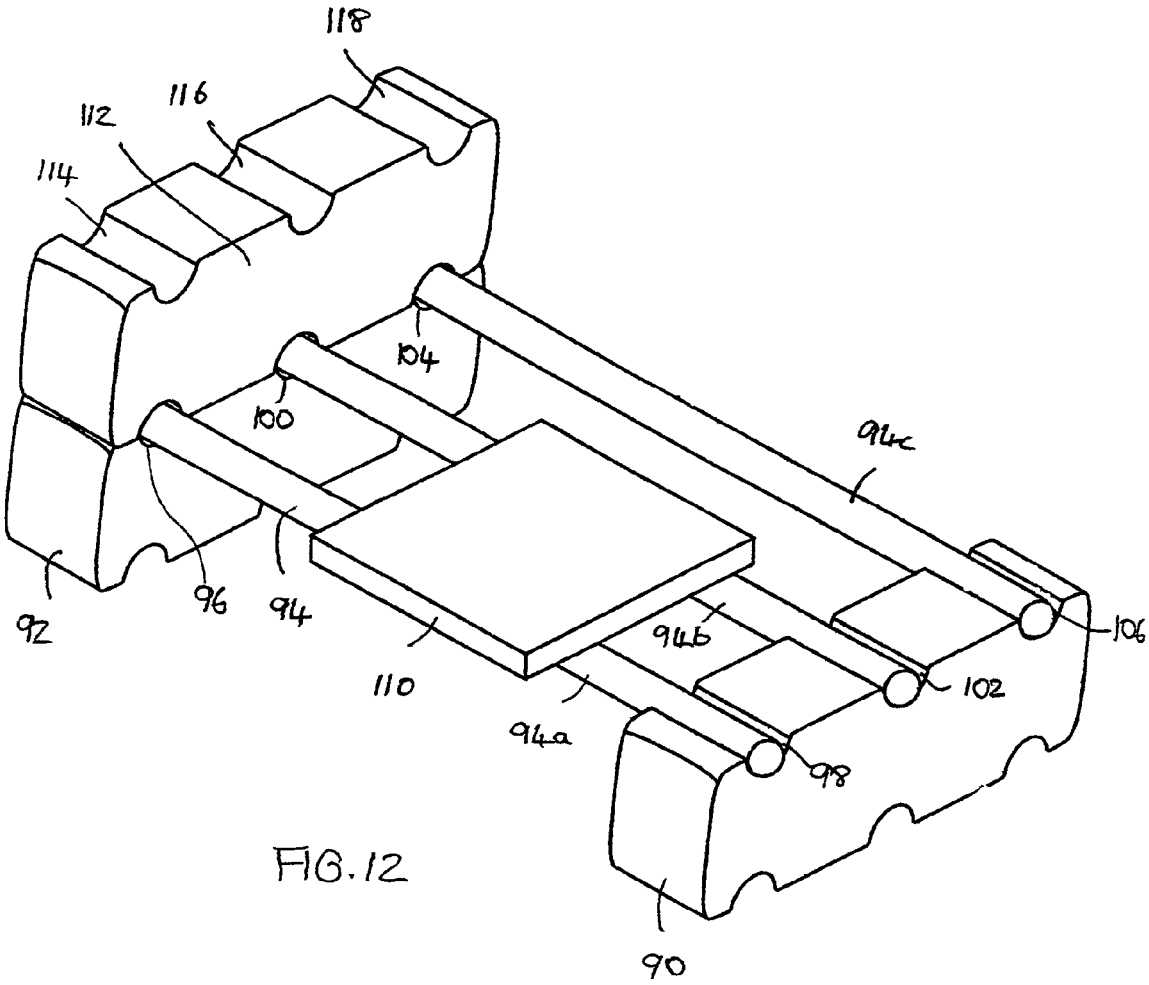
FIG. 12 is a perspective view showing the refractory blocks in combination with refractory rods illustrating how racks and frames of different size and form may be temporarily constructed for a given purpose.

In FIG. 12 of the drawings, an assembled or partially assembled system is shown to illustrate the capability of the invention and its capacity to be customized as may be needed. Based refractory blocks 90 and 92 are placed on a surface, typically the floor of the kiln (not shown) and are spaced apart by a distance a little less than the length of the rods 94 which will bridge the space between the refractory blocks 90 and 92. Rod 94*a* is placed in groove 96 of refractory block 92 and groove 98 of refractory block 90. Likewise, rod 94*b* is placed in grooves 100 and 102, and rod 94*c* is placed in grooves 104 and 106. The three rods 94*a*, 94*b* and 94*c* form a base or rack upon which a tile 110 may be placed for support during firing in the kiln.

Additional layers may be created as needed. This refractory block 112 is placed above refractory block 92 in a stacked fashion with the three grooves on the lower surface of the refractory block 112 covering the ends of rods 94*a*, 94*b* and 94*c*. The refractory block 112 therefore has two important functions: first, it secures the rods 94 so that they are less likely to move out of grooves 96, 100 and 104, and, second, it provides a surface and grooves 114, 116 and 118 for accommodating another row of rods to create another rack vertical disposed above the rack formed by rods 94. Additionally refractory blocks like the ones shown in this figure can be utilized to create a storied set of racks which are stable and sized so as to make optimal use of the space within a kiln providing increased energy economy and faster processing of tiles within a given kiln.

Figure 13:
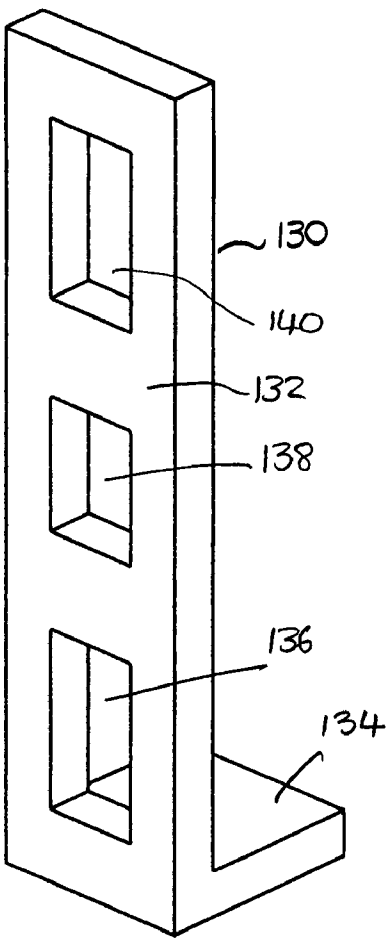
FIG. 13 is a perspective view of a support structure for use with stacked refractory blocks in accordance with yet a further embodiment of the invention.
Figure 15:
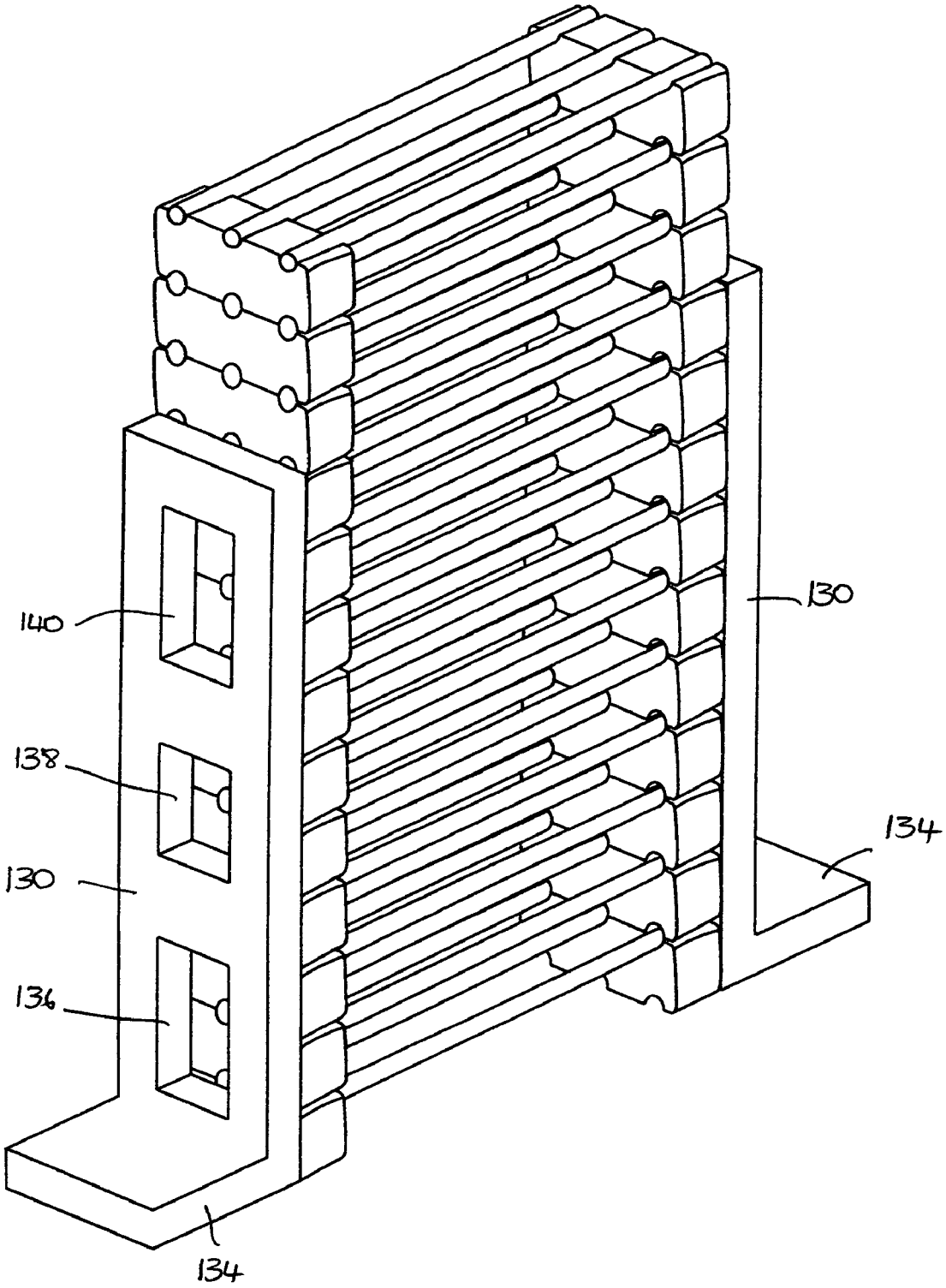
FIG. 15 shows a support structure as shown in FIG. 13 when used with a stack of refractory blocks.

FIG. 13 show another embodiment of the invention. A support block 130 comprises a vertical component 132, and a horizontal component or leg 134 which functions as a base and is placed on a substrate or surface in the kiln. The vertical component 132 has three apertures 136, 138 and 140. A pair of support blocks 130 are located spaced from each other in the kiln so that the stacked refractory blocks with rods can extend therebetween providing the shelf as described above with respect to other embodiments. FIG. 15 show a view of the opposing support blocks 130 with the refractory blocks therebetween.

Figure 14:
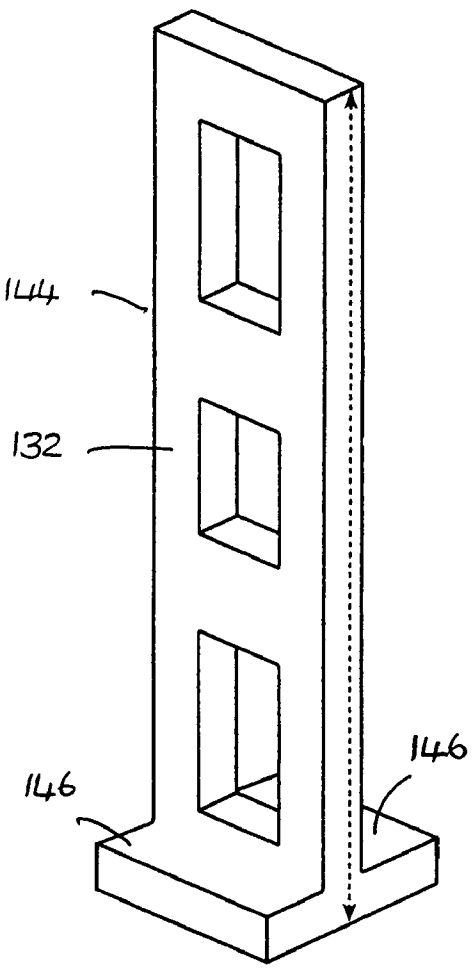
FIG. 14 is a perspective view of a support structure for use with stacked refractory blocks in accordance with still a further embodiment of the invention.

FIG. 14 shows a similar support block 144 to that illustrated in FIG. 13 except that the horizontal component or leg 146 extends to both sides of the vertical component 132. Figure show a view of the opposing support blocks 144 with the refractory blocks therebetween.

The support block 130 in FIG. 13 is designed as a support structure to be used in conjunction with the refractory blocks. Once the refractory blocks have been stacked in the kiln according to their intended use as has already been discussed detail, the support blocks 132 can be placed, if needed, alongside the stacked refractory blocks in contact with these blocks, as shown in FIG. 15. The vertical component 132 as shown is placed in contact with the stack of refractory blocks to give the stack extra support.

Figure 16:
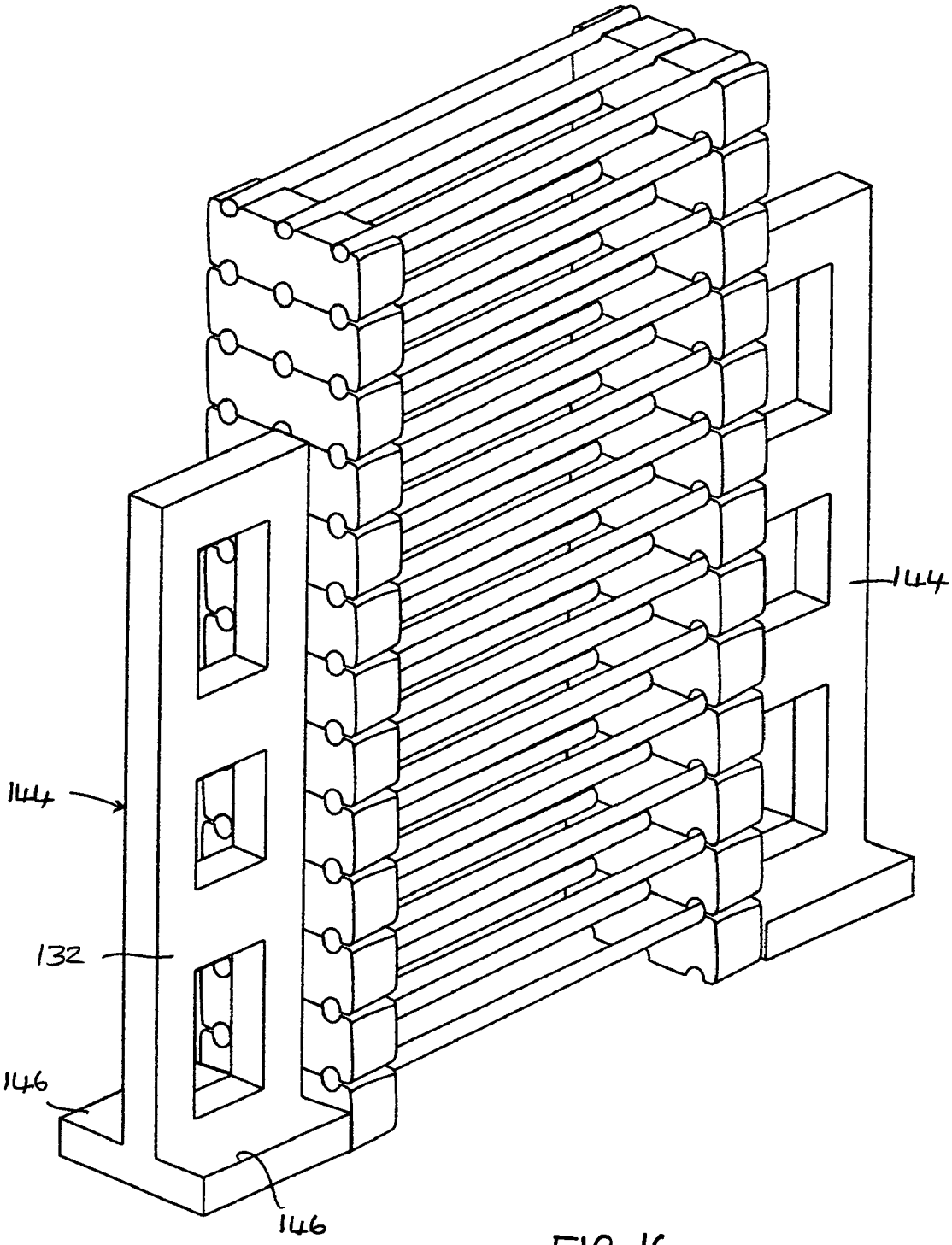
FIG. 16 shows a support structure as shown in FIG. 14 when used with a stack of refractory blocks.

The support block 144 in FIG. 14 is yet another version of a support structure also to be used in conjunction with the modular refractory blocks. Once the refractory blocks have been stacked in the kiln according to their intended use, extra support for the stacked refractory blocks may be desirable. FIG. 16 shows a depiction of how the support block 144 with the leg 146 on both sides of the vertical component may be used in a kiln with stacked refractory blocks and rods.

The apertures 136, 138 and 140 within the vertical component 132 in FIG. 13 and FIG. 14 generally have specific function in terms of how the pieces are used as support structures. The cuts or holes are placed in the surface mainly for the purpose of making these pieces lighter and less dense for the ease of manufacturing and use. They also facilitate holding the support structures when placing them and removing them in the kiln.

The invention is not limited to the precise details as described and illustrated herein. The blocks and rods may be of different dimensions and the blocks can be arranged in any suitable orientation and position so as to fit the desired objective. Shorter an longer rods can be used to form shorter and longer racks within a configured structure, and there may, in such an embodiment, be three or more stacks of blocks arranged along a line with connecting rods creating longer or shorter racks.

The invention claimed is:

1. A variable modular support system for use in a kiln comprising:

a plurality of refractory blocks each having an upper surface, a lower surface, opposing generally plain side edges and at least one transverse recess in each of the upper and the lower surfaces between the side edges, the plurality of refractory blocks comprising a first base refractory block and a substantially identical second base refractory block spaced from the first refractory block by a variable and selectable distance; and connecting rods extending from the recess of the first base refractory block or a substantially identical refractory block stacked thereon to the recess of the second base refractory block or a substantially identical refractory block stacked thereon, the connecting rods forming a rack or shelf located between the first base refractory block and the second base refractory block, the distance between the transverse recesses on the upper and lower surfaces respectively being of sufficient height to provide a storage space between the connecting rods and to accommodate objects being placed on the connecting rods to provide access thereto for loading and unloading such objects.

2. A variable modular support system as claimed in claim 1 wherein the refractory blocks have generally rectangular upper and lower surfaces.

3. A variable modular support system as claimed in claim 2 wherein both the upper and lower surfaces have three equispaced recesses thereon, the recesses of the upper surface being in substantial alignment with the recesses on the lower surface.

4. A variable modular support system as claimed in claim 1 wherein each recess is generally of semicircular shape.

5. A variable modular support system as claimed in claim 1 wherein each recess has a generally semicircular base portion and substantially vertical side walls.

6. A variable modular support system as claimed in claim 1 wherein the refractory block tapers slightly inwardly from the upper surface to the lower surface thereof.

7. A variable modular support system as claimed in claim 1 comprising a plurality of refractory blocks vertically stacked on the first base refractory block and a plurality of refractory blocks vertically stacked on the second base refractory block, and wherein connecting rods forming a plurality of vertically arranged shelves extend in a generally horizontal plane between the refractory blocks vertically stacked on the first base refractory block and the refractory blocks vertically stacked on the second base refractory block, the connecting rods being supported in the recesses of the refractory blocks.

8. A variable modular support system as claimed in claim 1 wherein the refractory blocks and connecting rods are variably configured so as to optimize the use of space in the kiln and structured to support objects being fired or cured in a kiln based on the dimensions of the objects.

9. A variable modular support system as claimed in claim 1 further comprising secondary support pieces which can be utilized to provide additional support to a vertical stack of refractory blocks.

10. A variable modular support system as claimed in claim 9 wherein the secondary support pieces comprises a support structure having a base and vertical wall, the vertical wall abutting against the vertical stack of refractory blocks.

11. A variable modular support system as claimed in claim 1 wherein the refractory blocks are comprised of a material which is selected for its ability to withstand multiple firings in the kiln at high temperatures.

12. A method of stacking objects to be fired in a kiln by placing the objects on a variable modular support system formed in the kiln, the method comprising:

arranging on the floor or base of the kiln a plurality of refractory blocks each having an upper surface, a lower surface, opposing generally plain side edges and at least one transverse recess in each of the upper and the lower surfaces between the side edges, the plurality of refractory blocks comprising a first base refractory block and a substantially identical second base refractory block spaced from the first refractory block by a variable and selectable distance; and placing connecting rods which extend from the recess of the first base refractory block or a substantially identical refractory block stacked thereon to the recess of the second base refractory block or a substantially identical refractory block stacked thereon, so that the connecting rods form a rack or shelf located between the first base refractory block and the second base refractory block, and constructing the distance between the transverse recesses on the upper and lower surfaces respectively to be of sufficient height to provide a storage space between the connecting rods and to accommodate objects being placed on the connecting rods to provide access thereto for loading and unloading such objects.

13. A method as claimed in claim 12 wherein three equispaced recesses are formed in both the upper and lower surfaces, the recesses of the upper surface being in substantial alignment with the recesses on the lower surface.

14. A method as claimed in claim 12 wherein a plurality of refractory blocks are vertically stacked on the first base refractory block and a plurality of refractory blocks are vertically stacked on the second base refractory block, and wherein connecting rods are placed to form a plurality of vertically arranged shelves which extend in a generally horizontal plane between the refractory blocks vertically stacked on the first base refractory block and the refractory blocks vertically stacked on the second base refractory block, the connecting rods being placed for support in the recesses of the refractory blocks.

15. A method as claimed in claim 12 wherein the refractory blocks and connecting rods are variably configured so as to optimize the use of space in the kiln and structured to support objects being fired or cured in a kiln based on the dimensions of the objects.

16. A method as claimed in claim 12 wherein secondary support pieces are used to provide additional support to a vertical stack of refractory blocks.

17. A method as claimed in claim 12 wherein the refractory blocks are comprised of a material which is selected for its ability to withstand multiple firings in the kiln at high temperatures.

* * * * *